US006705895B2

(12) United States Patent
Hasircoglu

(10) Patent No.: US 6,705,895 B2
(45) Date of Patent: Mar. 16, 2004

(54) ORTHOGONAL INTERFACE FOR CONNECTING CIRCUIT BOARDS CARRYING DIFFERENTIAL PAIRS

(75) Inventor: Alexander W. Hasircoglu, Columbia, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/132,120

(22) Filed: Apr. 25, 2002

(65) Prior Publication Data

US 2003/0203676 A1 Oct. 30, 2003

(51) Int. Cl.[7] ..... H01R 13/468
(52) U.S. Cl. ..... 439/608; 439/108
(58) Field of Search ..... 439/608, 76.1, 439/61, 79, 108, 101, 65, 701, 594, 717; 361/796

(56) References Cited

U.S. PATENT DOCUMENTS

| | | | | |
|---|---|---|---|---|
| 4,472,765 | A | 9/1984 | Hughes | 361/413 |
| 4,612,519 | A | 9/1986 | Gargini et al. | 333/103 |
| 4,703,394 | A | 10/1987 | Petit et al. | 361/413 |
| 4,876,630 | A | 10/1989 | Dara | 361/413 |
| 5,062,801 | A | 11/1991 | Roos | 439/61 |
| 5,122,691 | A | 6/1992 | Balakrishnan | 307/475 |
| 5,167,511 | A | 12/1992 | Krajewski et al. | 439/61 |
| 5,211,565 | A | 5/1993 | Krajewski et al. | 439/65 |
| 5,296,748 | A | 3/1994 | Wicklund et al. | 307/303.1 |
| 5,335,146 | A | 8/1994 | Stucke | 361/785 |
| 5,339,221 | A | 8/1994 | Conroy-Wass et al. | 361/796 |
| 5,352,123 | A | 10/1994 | Sample et al. | 439/61 |
| 5,429,521 | A | 7/1995 | Morlion et al. | 439/108 |
| 5,870,528 | A | 2/1999 | Fukuda | 395/80 |
| 5,887,158 | A | 3/1999 | Sample et al. | 395/500 |
| 5,924,899 | A | 7/1999 | Paagman | |
| 6,015,300 | A | 1/2000 | Schmidt, Jr. et al. | 439/61 |
| 6,083,047 | A * | 7/2000 | Paagman | 439/608 |
| 6,102,747 | A | 8/2000 | Paagman | |
| 6,163,464 | A | 12/2000 | Ishibashi et al. | 361/788 |
| 6,168,469 | B1 | 1/2001 | Lu | |
| 6,171,115 | B1 | 1/2001 | Mickievicz et al. | |
| 6,267,604 | B1 * | 7/2001 | Mickievicz et al. | 439/79 |
| 6,540,522 | B2 * | 4/2003 | Sipe | 439/608 |

* cited by examiner

*Primary Examiner*—Renee Luebke
*Assistant Examiner*—Felix D. Figueroa

(57) ABSTRACT

An electrical connector assembly is provided including a plurality of wafers having ground and signal traces with the signal traces being arranged in differential pairs, a first connector housing including channels adapted to retain a first group of wafers, and a second connector housing including channels adapted to retain a second group of wafers. The electrical connector assembly also includes signal contacts joining the differential pairs of the signal traces on the first group of wafers with corresponding differential pairs of the signal traces on the second group of wafers. The first and second connector housings join the first group of wafers in a non-parallel relationship to the second group of wafers.

25 Claims, 12 Drawing Sheets

ORTHOGONAL INTERFACE FOR CONNECTING CIRCUIT BOARDS CARRYING DIFFERENTIAL PAIRS

BACKGROUND OF THE INVENTION

Certain embodiments of the present invention generally relate to connectors that electrically connect circuit boards to one another and more particularly relate to electrical contacts that join differential pairs of signal traces on first and second electrical wafers orthogonally aligned with one another.

Various electronic systems, such as computers, comprise a wide array of components mounted on printed circuit boards, such as daughterboards, backplanes, motherboards, and the like which are interconnected to transfer signals and power throughout the systems. The transfer of signals and power between the circuit boards or electrical wafers requires electrical connectors between the printed circuit boards. The printed circuit boards may be aligned at various angles to one another (hereafter collectively referred to as orthogonal). Typical connector assemblies include a plug connector and a receptacle connector. Each plug and receptacle connector may house a plurality of electrical wafers. An electrical wafer may be a thin printed circuit board or a series of laminated contacts within a plastic insulator. The electrical wafers within one connector may be mated along an edge with the electrical wafers in the other connector in an orthogonal manner.

Conventional electrical connectors for orthogonally aligned electrical wafers include ground contacts and signal contacts. Each electrical wafer has contact pads along a mating edge and along a base edge. Each ground contact engages one ground contact pad on one side of a horizontal wafer along the mating edge and two ground contact pads on opposite sides of a vertical electrical wafer. Likewise, each signal contact engages one signal contact pad on one side of a horizontal wafer (opposite the signal contact pad) and two signal contact pads on opposite sides of a vertical electrical wafer. A single trace extends from each contact pad along the mating edge of the horizontal wafer to a corresponding contact pad along the base edge. Similarly a single trace extends from each opposite pair of contact pads along the mating edge of the vertical wafer to a corresponding contact pad along the base edge. The contact pads along the base edge of both the horizontal and vertical wafers are in turn connected to contact pads on the printed circuit boards attached to both connectors, thus creating an electrical path between the printed circuit boards.

However, conventional electrical connectors for orthogonally aligned printed circuit boards only carry traces configured for single ended applications. Hence, each individual trace on the wafers is treated as an independent signal path that is preferably electromagnetically isolated from other traces on the wafers. Today, printed circuit boards are being used to carry signals arranged in differential pairs as well. Consequently, it would be advantageous for an orthogonal electrical connector to maintain the signals in a differential pair arrangement. Thus, there is a need for electrical connectors that convey differential pair signals across orthogonal wafers from one printed circuit board to another printed circuit board.

BRIEF SUMMARY OF THE INVENTION

In accordance with certain embodiments of the present invention, an electrical connector assembly is provided that includes a plurality of wafers having ground and signal traces with the signal traces being arranged in differential pairs. The electrical connector assembly includes a first connector housing that has channels adapted to retain a first group of wafers, and a second connector housing that has channels adapted to retain a second group of wafers. The electrical connector assembly also includes signal contacts joining the differential pairs of the signal traces on the first group of wafers with corresponding differential pairs of the signal traces on the second group of wafers. The first and second connector housings join the first group of wafers in a non-parallel relationship to the second group of wafers.

In certain other embodiments, an electrical connector assembly includes a plurality of wafers having ground and signal traces with the signal traces being arranged in differential pairs. The electrical connector assembly includes a first connector housing that has channels adapted to retain a first group of wafers, and a second connector housing that has channels adapted to retain a second group of wafers. The electrical connector assembly also includes a wafer interface with cavities and ground and signal contacts loaded into the cavities. The signal contacts are arranged in differential pairs and with corresponding ground contacts located therebetween along a first axis. Each ground contact and signal contact has ground beams and signal beams, respectively. Each ground beam is located immediately adjacent and facing a corresponding signal beam. The wafer interface holds the signal beams in a biased state to deflect the signal beams away from corresponding ground beams to define gaps therebetween.

Figure 1:
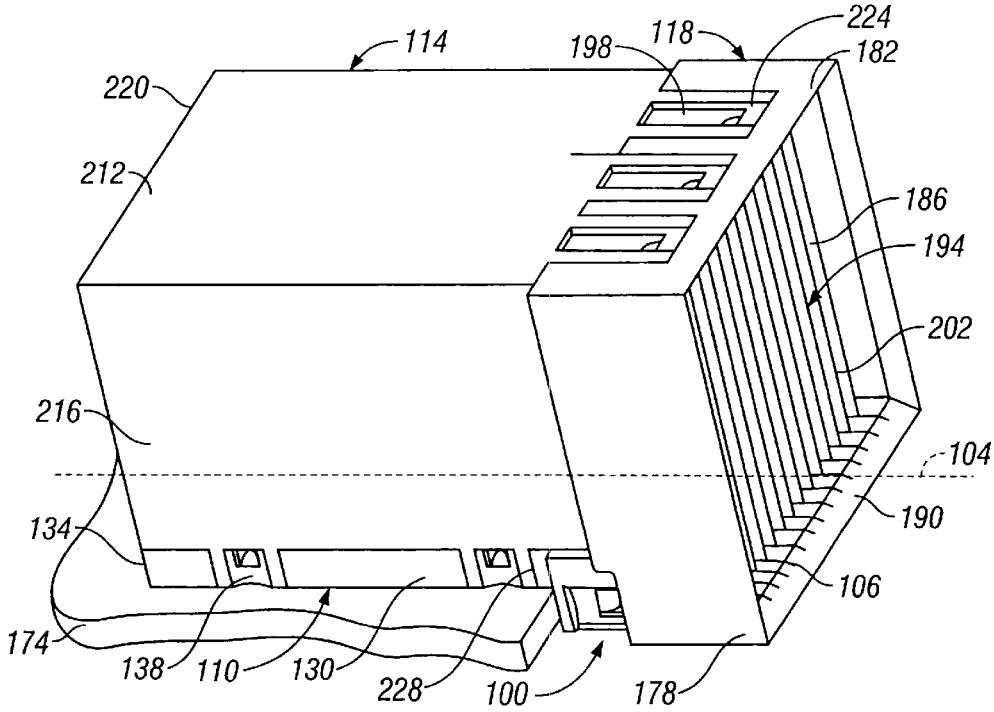
FIG. 1 illustrates an isometric view of a receptacle connector formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of a receptacle connector 100 formed in accordance with an embodiment of the present invention. An organizer base 110 is attached to a printed circuit board 174 in alignment with a horizontal axis 104. The organizer base 110 has side walls 130 and a rear wall 134 that include latch mating members 138 that receive and retain cover latches 228 formed on a cover 114.

An interface shroud 118 is secured to the organizer base 110 by latch recesses 198 that are formed on the exterior of a top wall 182 and a bottom wall 190 and that receive latch members 224 and 142 (FIG. 2) of the cover 114 and the organizer base 110, respectively. Side walls 178, a wafer projection wall 186, the top wall 182, and the bottom wall 190 define an interface cavity 194 which receives and mates with a corresponding plug connector 200 (FIG. 3).

Figure 2:
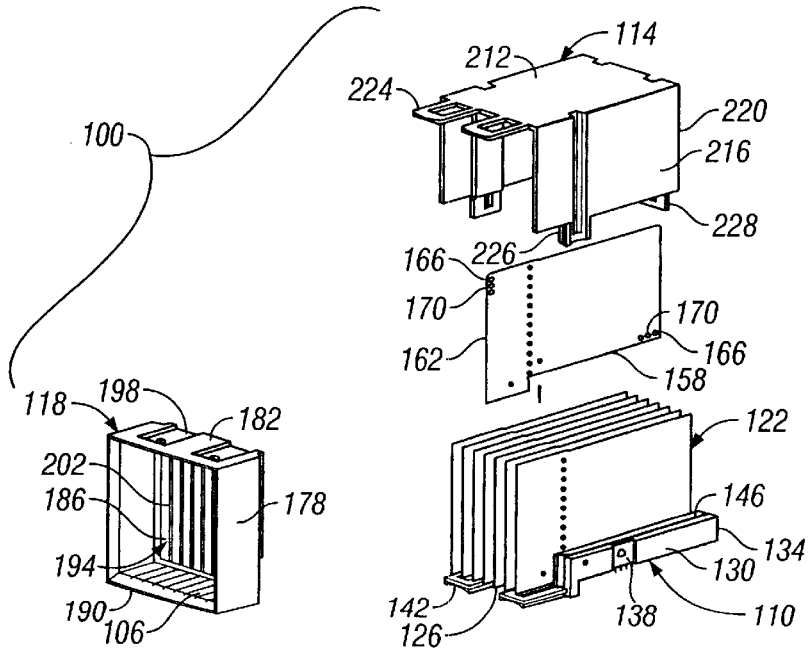
FIG. 2 illustrates an exploded view of the receptacle connector of FIG. 1 with receptacle wafers in accordance with an embodiment of the present invention.
Figure 3:
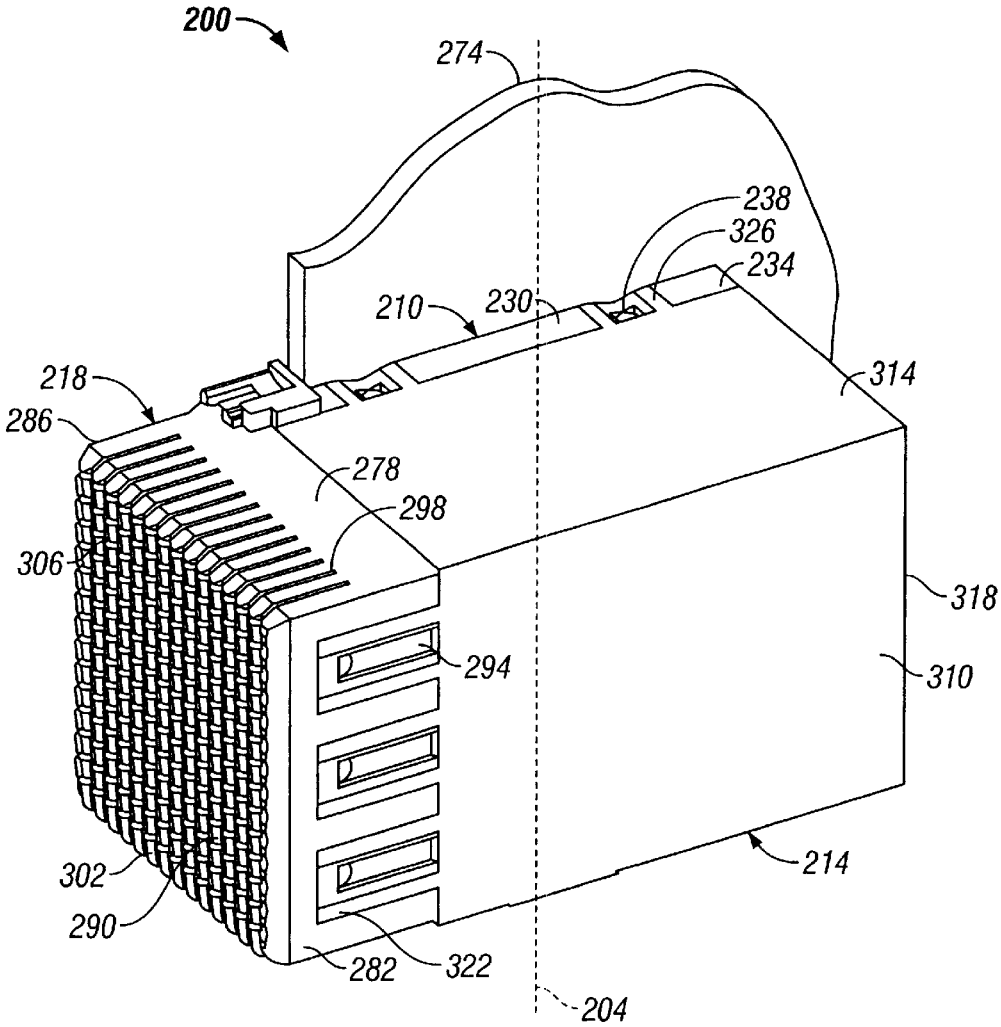
FIG. 3 illustrates an isometric view of a plug connector formed in accordance with an embodiment of the present invention.

FIG. 2 illustrates an exploded view of the receptacle connector 100 of FIG. 1 with receptacle wafers 122. Latch members 142 extend outwardly from the bottom of the organizer base 110 at an interface side 126. The organizer base 110 also includes channels 146 extending along a length thereof. Each channel 146 receives and retains a receptacle wafer 122 along a base mating edge 258. Each receptacle wafer 122 also includes a plug mating edge 262. The base mating edge 158 and plug mating edge 162 have signal and ground contact pads 266 and 270 on each side of the receptacle wafer 122.

Signal contacts 12 (FIG. 5) and ground contacts 22 (FIG. 6) are connected to corresponding signal and ground contact pads 266 and 270, respectively, on the plug mating edge 262. The signal and ground contact pads 166 and 170 on the base mating edge 158 are pinched between double prongs of compliant contacts within the channels 146. The compliant contacts in turn are connected to the printed circuit board 174 (FIG. 1) located under the organizer base 110. Thus, an electrical path may be established between the printed circuit board 174 and the receptacle wafers 122.

The wafer projection wall 186 of the interface shroud 118 includes slots 202 extending from the top wall 182 to the bottom wall 190. The slots 202 allow the receptacle wafers 122 to pass therethrough. The side of the bottom wall 190 within the interface cavity 194 includes guide slots 106 that receive and securely retain lower edges of the receptacle wafers 122. Additionally, the side of the top wall 182 facing the interface cavity 194 may also include guide slots that receive and securely retain upper edges of the receptacle wafers 122. A top wall 212, side walls 216, and a rear wall 220 of the cover 114 define an open cavity that contains the receptacle wafers 122.

FIG. 3 illustrates an isometric view of a plug connector 200 formed in accordance with an embodiment of the present invention. An organizer base 210 is suspended with a printed circuit board 274 in alignment with a vertical axis 204 so that the plug connector 200 is orthogonally matable with the receptacle connector 100 of FIG. 1. The organizer base 210 has side walls 230 and a rear wall 234 that include latch mating members 238 that receive and retain cover latches 326 formed on a cover 214. An interface housing 218 is secured to the organizer base 210 by latch recesses 294 that are formed on the exterior of a top wall 282 and a bottom wall 286 and that receive latch members 322 and 242 (FIG. 4) of the cover 214 and the organizer base 210, respectively.

Figure 4:
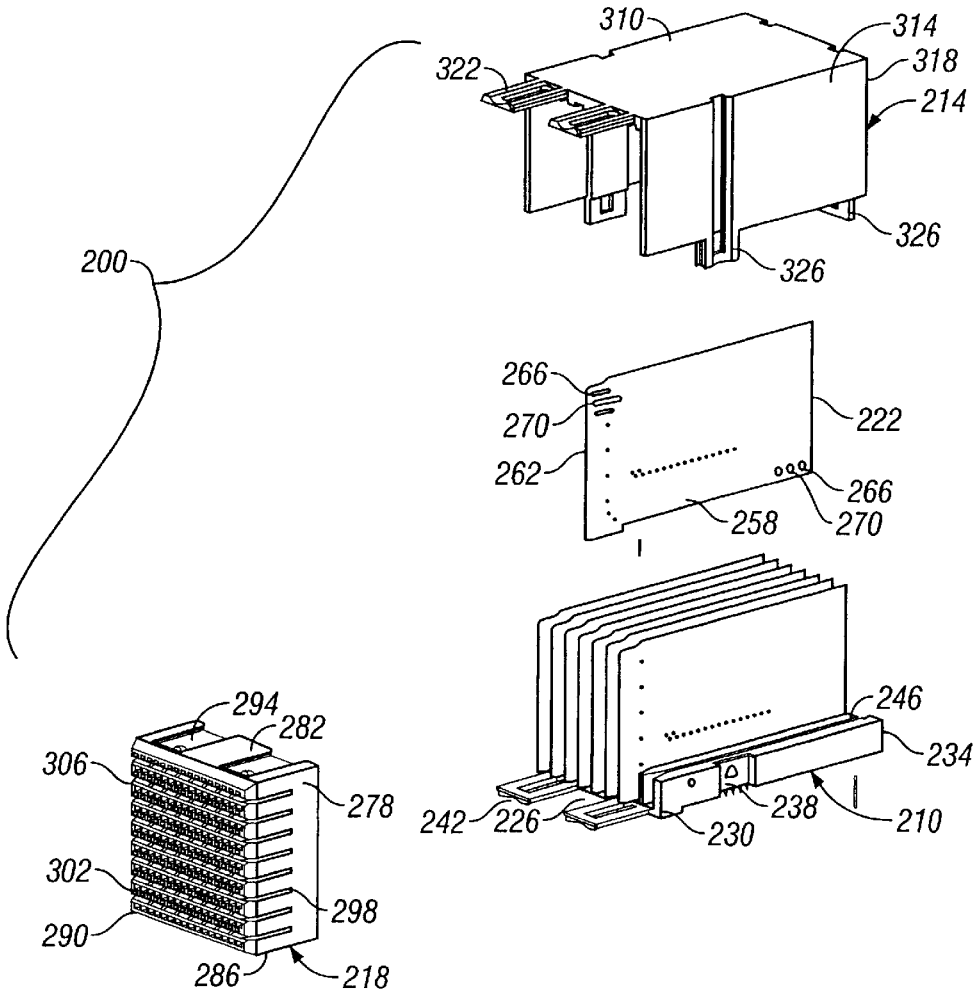
FIG. 4 illustrates an exploded view of the plug connector of FIG. 3 with plug wafers in accordance with an embodiment of the present invention.

FIG. 4 illustrates an exploded view of the plug connector 200 of FIG. 3 with plug wafers 222 in accordance with an embodiment of the present invention. A top wall 310, side walls 314, and a rear wall 318 of the cover 214 define an open cavity that contains the plug wafers 222. Latch members 242 extend outwardly from the bottom of the organizer base 210 at an interface side 226. The organizer base 210 also includes channels 246 extending along a length thereof. Each channel 246 receives and retains a plug wafer 222 along a base mating edge 158. Each plug wafer 222 also includes a receptacle mating edge 162. The base mating edge 158 and the receptacle mating edge 162 have signal and ground contact pads 266 and 270 on each side of the plug wafer 222.

Signal contacts 12 (FIG. 5) and ground contacts 22 (FIG. 6) are connected to corresponding signal and ground contact pads 166 and 170, respectively, on the receptacle mating edge 162 when the interface housing 218 is secured to the organizer base 210. The signal and ground contact pads 166 and 170 of the base mating edge 158 are pinched between double prongs of compliant contacts within the channels 246. The compliant contacts in turn are connected to the printed circuit board 274 (FIG. 3) located alongside the organizer base 210. Thus, an electrical path may be established between the printed circuit board 274 and the plug wafers 222.

Retention channels 298 extend from side walls 278 of the interface housing 218 extending along the length of an interface wall 290. When the organizer base 210 is vertically aligned with the printed circuit board 274 of FIG. 3, the retention channels 298 are oriented to receive the receptacle wafers 122 aligned with the horizontal axis 104 of FIG. 2. The interface wall 290 includes guide members 302 located between the retention channels 298 that support and align the ground and signal contacts 22 and 12 connected to the plug wafers 222, as the receptacle wafers 122 pass through the retention channels 298 and engage the ground and signal contacts 22 and 12. Thus, the interface shroud 118 of the receptacle connector 100 (FIG. 1) receives and snapably retains the interface housing 218 of the plug connector 200, such that the receptacle wafers 122 electrically mate with the plug wafers 222 in an orthogonal alignment.

Figure 5:
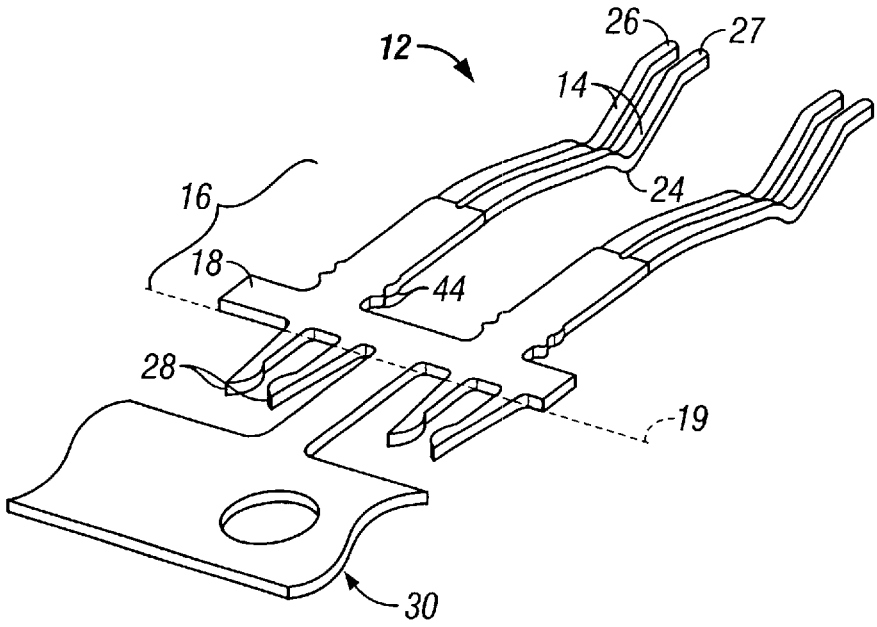
FIG. 5 illustrates an isometric view of a pair of signal contacts attached to a carrier strip in accordance with an embodiment of the present invention.

FIG. 5 illustrates an isometric view of a pair of signal contacts 12 attached to a carrier strip 30 in accordance with an embodiment of the present invention. The signal contact 12 includes plug interconnect beams 14 on one end of an intermediate retention portion 16 and a signal receptacle interconnect 18 shaped like a tuning fork on the opposite end of the intermediate retention portion 16. The signal receptacle interconnect 18 is horizontally offset from the intermediate retention portion 16 along a horizontal axis 19. The plug interconnect beams 14 are curved to form contact points 24. The plug interconnect beams 14 include tips 26 and 27 that retain the signal contacts 12 in a preloaded position as described below. The signal receptacle interconnect 18 includes two prongs 28. The signal contacts 12 are cut apart from each other and from the carrier strip 30, and positioned on the receptacle wafers 122 (FIGS. 1 and 2) with the prongs 28 of each signal contact 12 straddling the receptacle mating edge 262 of a plug wafer 222. One prong 28 contacts a signal contact pad 166 on one side of the plug wafer 222 and the other prong 28 contacts a signal contact pad 166 on the other side of the plug wafer 222. The two signal contact pads 166 contacted by the same signal receptacle interconnect 18 are connected to each other through the plug wafer 222 by a via (not shown).

When the plug and receptacle connectors 200 (FIGS. 3 and 4) and 100 (FIGS. 1 and 2) are engaged, a plug wafer 222 is positioned orthogonal to the receptacle wafer 122 and the contact points 24 of the plug interconnect beams 14 contact a signal contact pad 266 on one side of the receptacle wafer 122. The intermediate retention portion 16 of the signal contact 12 includes ridges 44 that engage the guide members 302 of the interface wall 290 (FIGS. 3 and 4) and retain the signal contacts 12 within the interface housing 218.

Figure 6:
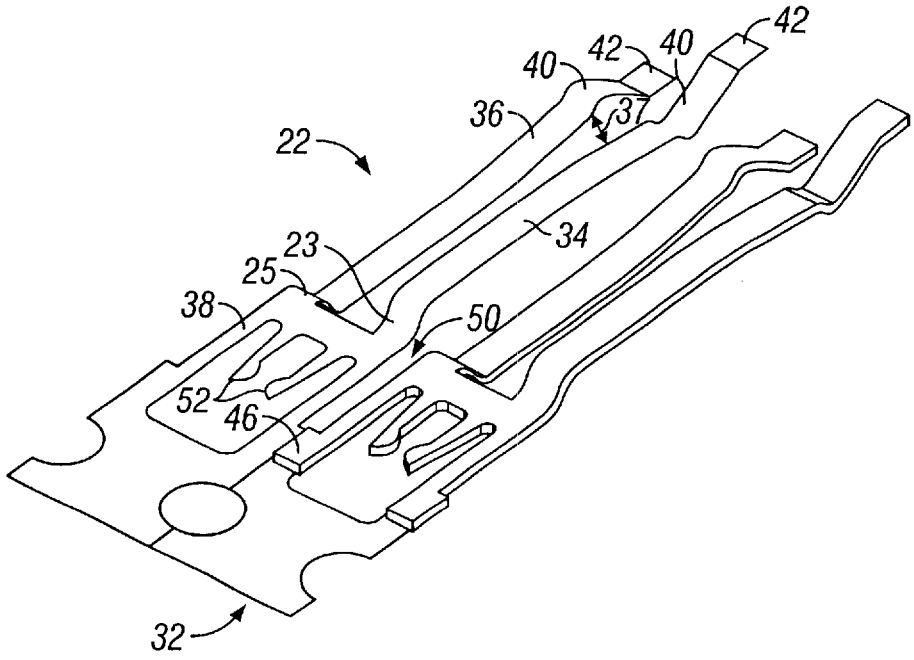
FIG. 6 illustrates an isometric view of a pair of ground contacts attached to a carrier strip in accordance with an embodiment of the present invention.

FIG. 6 illustrates an isometric view of a pair of ground contacts 22 attached to a carrier strip 32. The ground contacts 22 include first and second plug interconnects 34 and 36 extending from a ground receptacle interconnect 38. The first plug interconnect 34 is bent upward proximate a first end 23 near the ground receptacle interconnect 38. The second plug interconnect 36 is bent downward in the opposite direction proximate a first end 25 near the ground receptacle interconnect 38. Therefore, a gap 37 is defined between the first and second plug interconnects 34 and 36. The first and second plug interconnects 34 and 36 are curved to form contact points 40 and include tips 42 that retain the ground contacts 22 in a preloaded position as described below. The ground receptacle interconnect 38 includes two prongs 52 extending from a side opposite to the first and second plug interconnects 34 and 36. The ground contacts 22 are cut away from the carrier strip 32 but remain attached to each other even after being positioned on the receptacle wafers 122 (FIGS. 1 and 2). The ground contacts 22 remain connected to each other through securing arms 46 that hold the ground receptacle interconnect 38 apart by a gap 50. In an alternative embodiment, the ground contacts 22 are separate from each other.

The ground contacts 22 are positioned on the plug wafers 222 with the prongs 52 of each ground contact 22 straddling the receptacle mating edge 162 of a plug wafer 222. One prong 52 contacts a ground contact pad 170 on one side of the plug wafer 222 and the other prong 52 contacts a ground contact pad 170 on the other side of the plug wafer 222. The two ground contact pads 170 contacted by the same ground receptacle interconnect 38 are connected to each other through the plug wafer 222 by a via (not shown). When the plug and receptacle connectors 200 (FIGS. 3 and 4) and 100 are mated with one another, a plug wafer 222 is positioned orthogonal to a receptacle wafer 122 and the contact point 40 of the first plug interconnect 34 contacts a ground contact pad 270 on one side of the plug wafer 222, while the contact point 40 of the second plug interconnect 36 contacts a ground contact pad 270 on the other side of the receptacle wafer 122. The two ground contact pads 270 contacted by the same ground contact 22 are connected to each other through the receptacle wafer 122 by a via. The gaps 50 enclose and engage the guide members 302 (FIG. 4) of the interface wall 290 and retain the ground contacts 22 within the interface housing 218.

Figure 7:
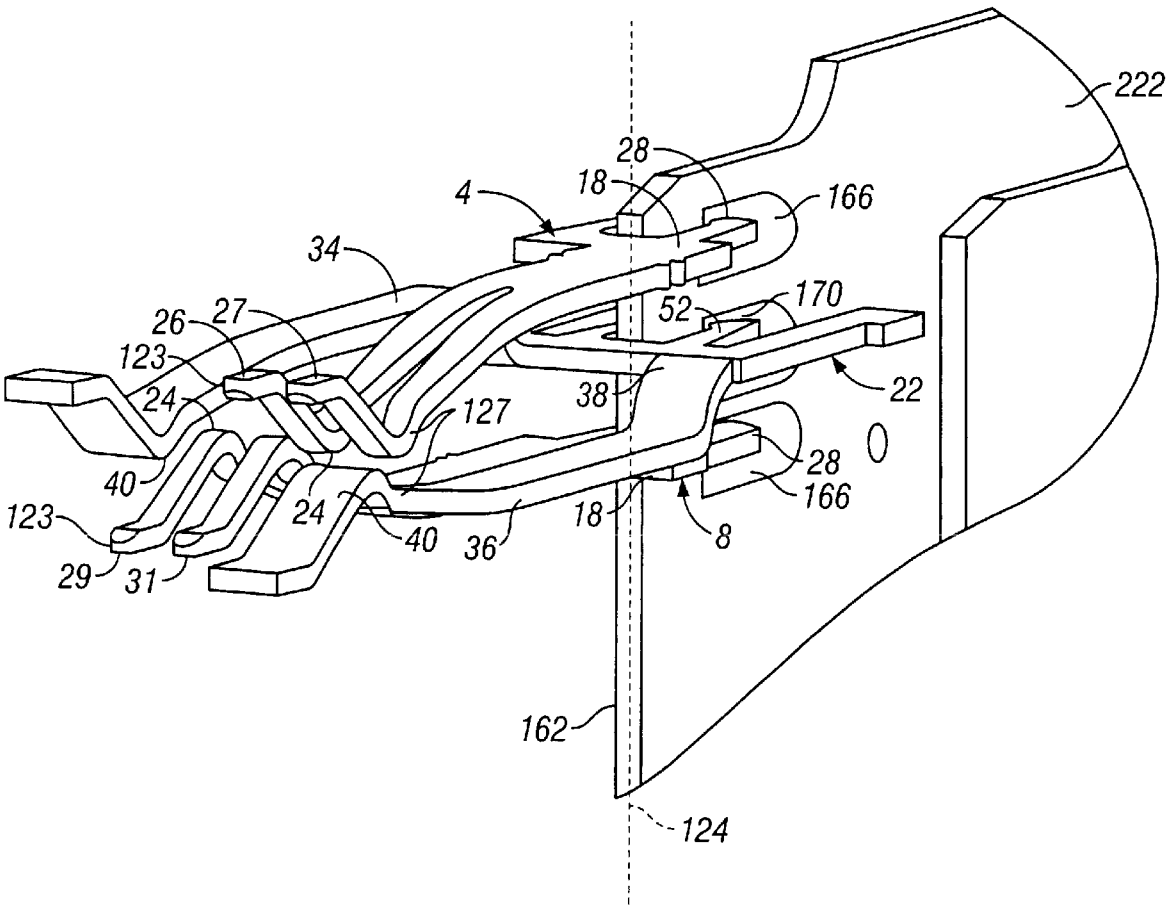
FIG. 7 illustrates an isometric view of a ground contact and an upper and a lower signal contact and connected to a receptacle wafer in accordance with an embodiment of the present invention.

FIG. 7 illustrates an isometric view of a ground contact 22 and an upper and a lower signal contact 4 and 8 connected to a plug wafer 222. The upper and lower signal contacts 4 and 8 form a contact differential pair 123 and the ground contact 22 is positioned therebetween along a vertical axis 124 defined by the receptacle mating edge 262. The upper signal contact 4 is offset from the vertical axis 124 to be aligned above the second plug interconnect 36 while the lower contact 8 is offset from the vertical axis 124 to be aligned below the first plug interconnect 34. A gap 127 is defined between the upper signal contact 4 and the second plug interconnect 36 and between the lower signal contact 8 and the first plug interconnect 34. The upper signal contact 4 has the tips 26 and 27 while the lower signal contact 8 has tips 29 and 31.

During connection, when the plug connector 200 (FIGS. 3 and 4) and the receptacle connector 100 (FIGS. 1 and 2) are mated, a receptacle wafer 122 is slidably inserted into the gap 127. The ground contact pads 270 engage the contact points 40 on the first and second plug interconnects 34 and 36, and the signal contact pads 266 engage the contact points 24 on the upper and lower signal contacts 4 and 8.

Figure 8:
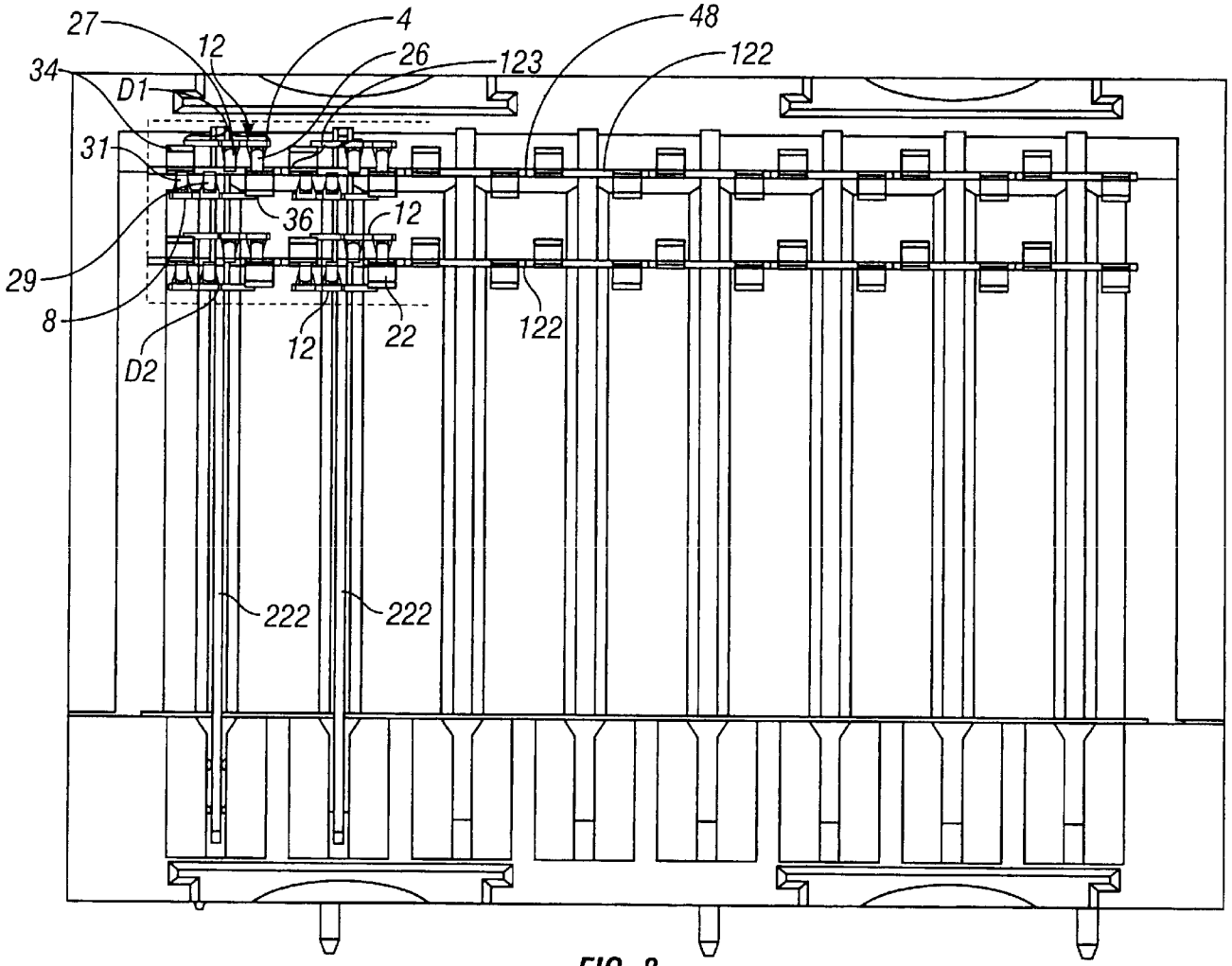
FIG. 8 illustrates a front view of signal contacts and ground contacts of FIG. 7 positioned on parallel plug wafers.

FIG. 8 illustrates a front view of signal contacts 12 and ground contacts 22 positioned on parallel plug wafers 222. As shown, the first and second plug interconnects 34 and 36 are offset from each other along a horizontal axis 48 by a distance D1. The upper and lower signal contacts 4 and 8 are offset from each other along the horizontal axis 48 by a distance D2. Distance D1 is greater than distance D2. The signal and ground contact pads 266 and 270 (FIG. 4) on a receptacle wafer 122 that correspond to the upper and lower signal contacts 4 and 8 and the first and second plug interconnects 34 and 36, respectively, are similarly offset on each side of the receptacle wafer 122. The tip 26 of the upper signal contact 4 is positioned above the second plug interconnect 36 and the tip 31 of the lower signal contact 8 is positioned below the first plug interconnect 34. The tips 27 and 29 of the upper and lower signal contacts 4 and 8, respectively, are offset inward between the first and second plug interconnects 34 and 36 along the horizontal axis 48 and are separated by the distance D2. The first and second plug interconnects 34 and 36 are offset wider than the upper and lower signal contacts 4 and 8 along the horizontal axis 48 to serve as buffers between adjacent contact differential pairs 123 on a receptacle wafer 122 and thus prevent electromagnetic coupling interference between the signal contacts 12 of adjacent contact differential pairs 123.

Figure 9:
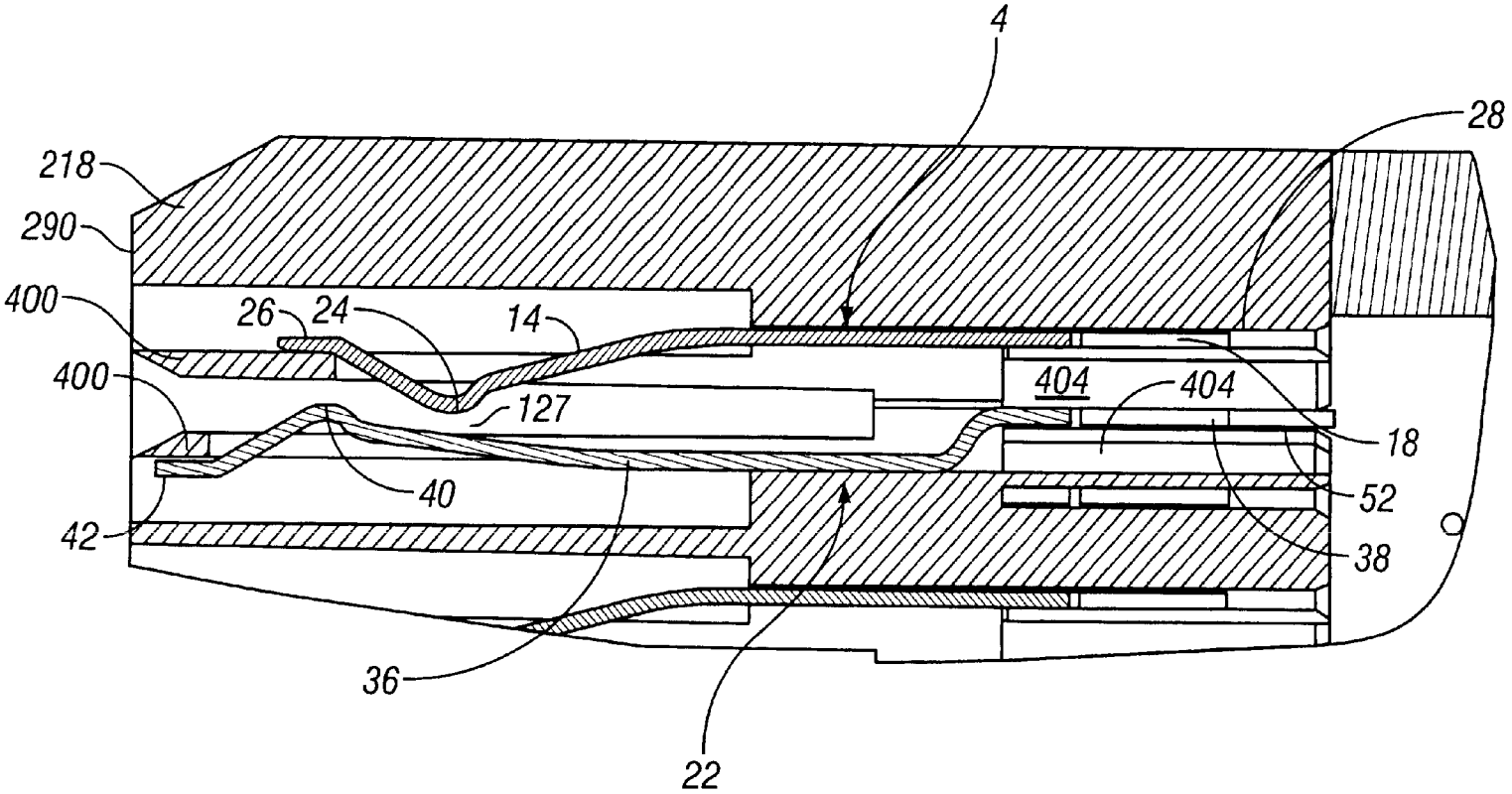
FIG. 9 illustrates a section view of a signal contact and a second plug interconnect of FIG. 8 loaded within the interface housing.

FIG. 9 illustrates a side view of an upper signal contact 4 and a second plug interconnect 36 loaded within the interior of the interface housing 218. Rectangular tip shelves 400 and interconnect shelves 404 are located along the interior of the interface wall 290 of the interface shroud 118. Before the interface housing 218 is connected to the plug wafers 222 (FIG. 2), the signal and ground contacts 12 (FIG. 5) and 22 are preloaded within the interface housing 218. The signal receptacle interconnect 18 of the upper signal contact 4 is preloaded between two interconnect shelves 404 with a tip shelf 400 resistibly suspending the tips 26 so that the plug interconnect beams 14 are bent slightly upward.

Similarly, the ground receptacle interconnect 38 of the ground contact 22 is preloaded between two interconnect shelves 404 with the tip 42 located below a tip shelf 400 so that the second plug interconnect 36 is prevented from being bent upward toward the tips 26 of the upper signal contact 4. The tip shelves 400 likewise operate to separate the lower signal contact 8 and the first plug interconnect 34 (not shown). The tip shelves 400 therefore prevent the upper signal contact 4 and the second plug interconnect 36 from touching, creating the gap 127 that extends between the upper signal contact 4 and the second plug interconnect 36. The gap 127 allows the receptacle wafers 122 (FIG. 4) to be inserted between the contact points 24 and 40 with minimal insertion force while preventing shorting the mating plug connector 200 and receptacle connector 100 (FIGS. 1 and 3) if the plug wafers 222 are inserted while the upper signal contact 4 carries a signal.

During assembly, the interface housing 218 holding the preloaded signal and ground contacts 12 and 22 is connected to the organizer base 210 (which contains the plug wafers 222) with the receptacle mating edges 162 of the plug wafers 222 sliding between and contacting the prongs 28 and 52 of the signal and ground receptacle interconnects 18 and 38. Then the plug connector 200 and the receptacle connector 100 are joined so that the receptacle wafers 122 slide into the gaps 127 with the signal and ground contact pads 266 and 270 engaging the contact points 24 and 40, respectively.

Figure 10:
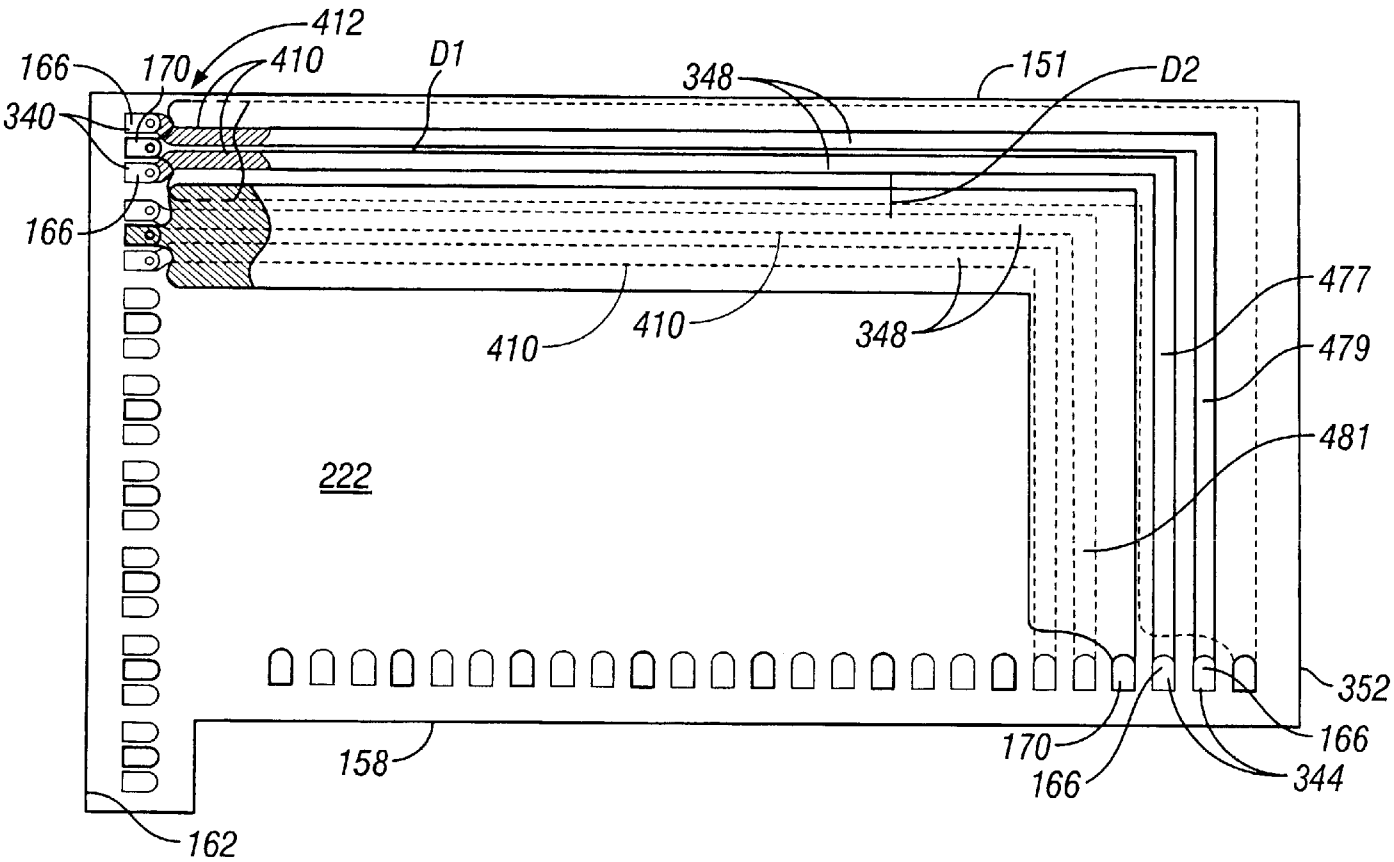
FIG. 10 illustrates a side view of a plug wafer.

FIG. 10 illustrates a side view of a plug wafer 222. The plug wafer 222 includes ground and signal contact pads 170 and 166 extending along the receptacle mating edge 162 and the base mating edge 158. On the receptacle mating edge 162, each ground contact pad 170 is situated between a corresponding differential pair 340 of signal contact pads 166, while on the base mating edge 158, each ground contact pad 170 is situated alongside a corresponding differential pair 344 of signal contact pads 166. The ground and signal contact pads 170 and 166 on one side of the plug wafer 222 are opposite identical ground and signal contact pads 170 and 166 on the other side of the plug wafer 222 and are connected to the ground and signal contact pads 170 and 166 on the other side of the plug wafer 222 by vias (not shown). Thus, as shown in FIG. 7, the ground and signal contact pads 170 and 166 engage the prongs 52 and 28 of the ground and signal receptacle interconnects 38 and 18, respectively, along the receptacle mating edge 162.

Returning to FIG. 10, the plug wafer 222 also includes signal and ground traces 410 and 412 on opposite sides of the plug wafer 222. The signal traces 410 extend in a differential pair 348 from a differential pair 340 of signal contact pads 166 on the receptacle mating edge 162 to a corresponding differential pair 344 of signal contact pads 166 on the base mating edge 158. Likewise, each ground trace 412 extends from one ground contact pad 170 on the receptacle mating edge 162 to a corresponding ground contact pad 170 on the base mating edge 158. For example, a ground trace 412 and a corresponding differential pair 348 of signal traces 410 extend from a ground contact pad 170 and a differential pair 340 of signal contact pads 166, respectively, nearest a top edge 151 along the receptacle wafer 122 parallel to the base mating edge 158. The ground trace 412 and differential pair 348 of signal traces 410 then extend perpendicularly downward parallel to the receptacle mating edge 162 to a corresponding ground contact pad 170 and differential pair 344 of signal contact pads 166, respectively, on the base mating edge 158 located near a rear edge 352 furthest from the receptacle mating edge 162. The signal and ground traces 410 and 412 thus form L-shaped paths across the plug wafers 222 that do not cross each other.

Each ground trace 412 and corresponding differential pair 348 of signal traces 410 extend along different sides of the plug wafer 222, alternating sides with every other ground trace 412 and corresponding differential pair 348 of signal traces 410. For example, the first differential pair 348 of signal traces 410 nearest the top edge 151 extends along the shown side of the plug wafer 222 while a corresponding first ground trace 412 extends along the opposite side of the plug wafer 222, as indicated by dashed lines. However, the second ground trace 412 nearest the top edge 151 extends along the shown side of the plug wafer 222 while a corresponding second differential pair 348 of signal traces 410 extends along the other side of the plug wafer 222, as indicated by dashed lines. The ground traces 412 and signal traces 410 are situated on opposite alternating sides of the plug wafer 222 so that the signal traces 410 within a differential pair 348 are more closely electro-magnetically (EM) coupled to one another than to any signal trace 410 in an adjacent differential pair 348.

The two signal traces 410 within a differential pair 348 are separated from each other by a trace-to-trace distance D1. The trace-to-trace distances D1 are illustrated as measured from adjacent edges of signal traces 410 of the same differential pair 348 along the shown-side of the plug wafer 222 by way of example only. Optionally, the trace-to-trace distances D1 may be measured from the center or opposite edges of signal traces 410. Each differential pair 348 of signal traces 410 is separated from an adjacent differential pair 348 of signal traces 410 by a pair-to-pair distance D2. The pair-to-pair distances D2 are illustrated in FIG. 10 as measured from edges of the adjacent signal traces 410 of the adjacent differential pairs 348 along the shown-side of the plug wafer 222 by way of example only. Optionally, the pair-to-pair distances D2 may be measured from the center or opposite edges of the adjacent signal traces 410 of adjacent differential pairs 348. The pair-to-pair distances D2 may equal one another. Optionally, the pair-to-pair distances D2 may differ from one another depending upon the shape and dimensions of the signal traces 410.

The pair-to-pair distance D2 is greater than the trace-to-trace distance D1. Therefore, each signal trace 410 within a differential pair 348 is closer to the other signal trace 410 in the differential pair 348 than the nearest signal trace 410 in an adjacent differential pair 348. The trace-to-trace distance D1 is less than the pair-to-pair distance D2 in order that the signal traces 410 within a single differential pair 348 of signal traces 410 are more closely EM coupled to one another than to any signal trace 410 in an adjacent differential pair 348 of signal traces 410. More specifically, signal trace 477 is spaced closer, and is more strongly EM coupled, to signal trace 479 than to signal trace 481.

Figure 11:
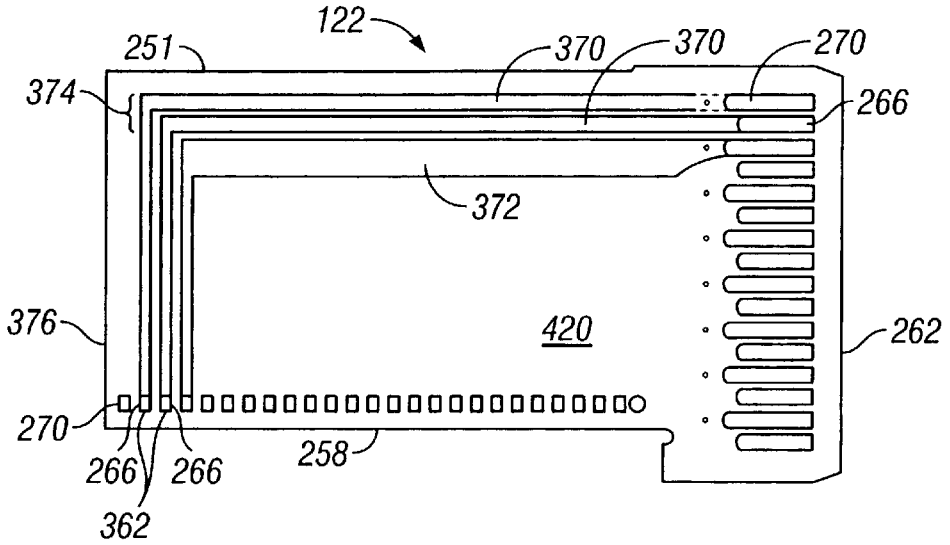
FIG. 11 illustrates a side view of a first side of a receptacle wafer.

FIG. 11 illustrates a side view of a first side 420 of a receptacle wafer 122. The receptacle wafer 122 includes ground and signal contact pads 270 and 266 extending along the plug mating edge 262 and the base mating edge 258. On the plug mating edge 262, each ground contact pad 270 is positioned above a corresponding signal contact pad 266, while on the base mating edge 258, each ground contact pad 270 is situated alongside a corresponding differential pair 362 of signal contact pads 266.

Figure 12:
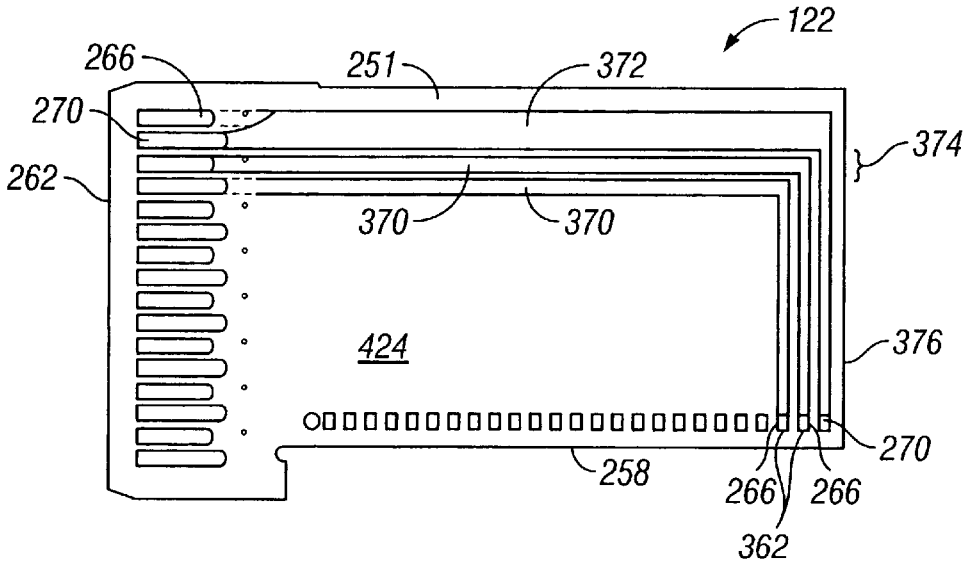
FIG. 12 illustrates a side view of a second side of the receptacle wafer.

FIG. 12 illustrates a side view of a second side 424 of the receptacle wafer 122. On the plug mating edge 262, each signal contact pad 266 is positioned above a corresponding ground contact pad 270. Therefore, each signal contact pad 266 on the first side 420 (FIG. 11) is opposite a ground contact pad 270 on the second side 424, and each ground contact pad 270 on the first side 420 is opposite a signal contact pad 266 on the second side 424, with the signal contact pads 266 forming differential pairs and being connected to each other by vias (not shown) through the receptacle wafer 122. Likewise, the ground contact pads 270 are connected to each other by vias (not shown). On the base mating edge 258, each ground contact pad 270 is situated alongside a corresponding differential pair 362 of signal contact pads 266. Therefore, the ground and signal contact pads 270 and 266 on the base mating edge 258 of the first side 420 are opposite identical ground and signal contact pads 270 and 266 on the base mating edge 258 of the second side 424 and are connected to the ground and signal contact pads 270 and 266 on the second side 424 by vias (not shown). The ground and signal contact pads 270 and 266 along the plug mating edge 262 engage the contact points 40 and 24 of the ground and signal contacts 22 and 12 (FIGS. 5 and 6), respectively, when the receptacle wafer 122 is orthogonally aligned with a plug wafer 222.

The receptacle wafer 122 also includes signal traces 370 and ground traces 372. For example, as shown in FIG. 11, signal traces 370 extend in a differential pair 374 from the differential pair of signal contact pads 266 nearest a top edge 251 (one signal trace 370 from the signal contact pad 266 on the first side 420 and one signal trace 370 extending through the receptacle wafer 122 from the signal contact pad 266 on the second side 424) to the differential pair 362 of signal contact pads 266 closest to a rear side 376 on the base mating edge 258. Likewise, as shown in FIG. 12, a corresponding ground trace 372 extends from both the ground contact pads 270 nearest the top edge 251 (one ground trace 372 from the ground contact pad 270 on the first side 420 and one ground trace 372 extending through the receptacle wafer 122 from the ground contact pad 270 on the second side 424) to the ground contact pad 270 closest to the rear side 376 on the base mating edge 258. Like the ground and signal traces 412 and 410 of the plug wafers 222 (FIG. 10), the ground and signal traces 372 and 370 of the receptacle wafers 122 extend in L-shaped paths.

Each ground trace 372 and corresponding differential pair 374 of signal traces 370 extend along opposite sides of the receptacle wafer 122, alternating sides with every other ground trace 372 and corresponding differential pair 374 of signal traces 370. For example, the first differential pair 374 of signal traces 370 nearest the top edge 251 extends along the first side 420 of the receptacle wafer 122, as shown in FIG. 11, while a corresponding ground trace 372 extends along the second side 424 of the receptacle wafer 122 opposite the differential pair 374, as shown in FIG. 12. However, the second ground trace 372 nearest the top edge 251 extends along the first side 420 of the receptacle wafer 122, as shown in FIG. 11, while a corresponding differential pair 374 of signal traces 370 extends along the second side 424 of the receptacle wafer 122 opposite the ground trace 372, as shown in FIG. 12. The ground traces 372 and signal traces 370 are situated on opposite alternating sides of the receptacle wafer 122 so that the signal traces 370 within a differential pair 374 are more closely EM coupled to one another than to any signal trace 370 in an adjacent differential pair 374. Additionally, the signal traces 370 of each differential pair 374 of signal traces 370 may be separated by a first distance that is smaller than a second distance which separates adjacent signal traces 370 of adjacent differential pairs 374 so that the signal traces 370 of a differential pair 374 are more closely EM coupled to one another than to any signal trace 370 in the adjacent differential pair 374.

Figure 13:
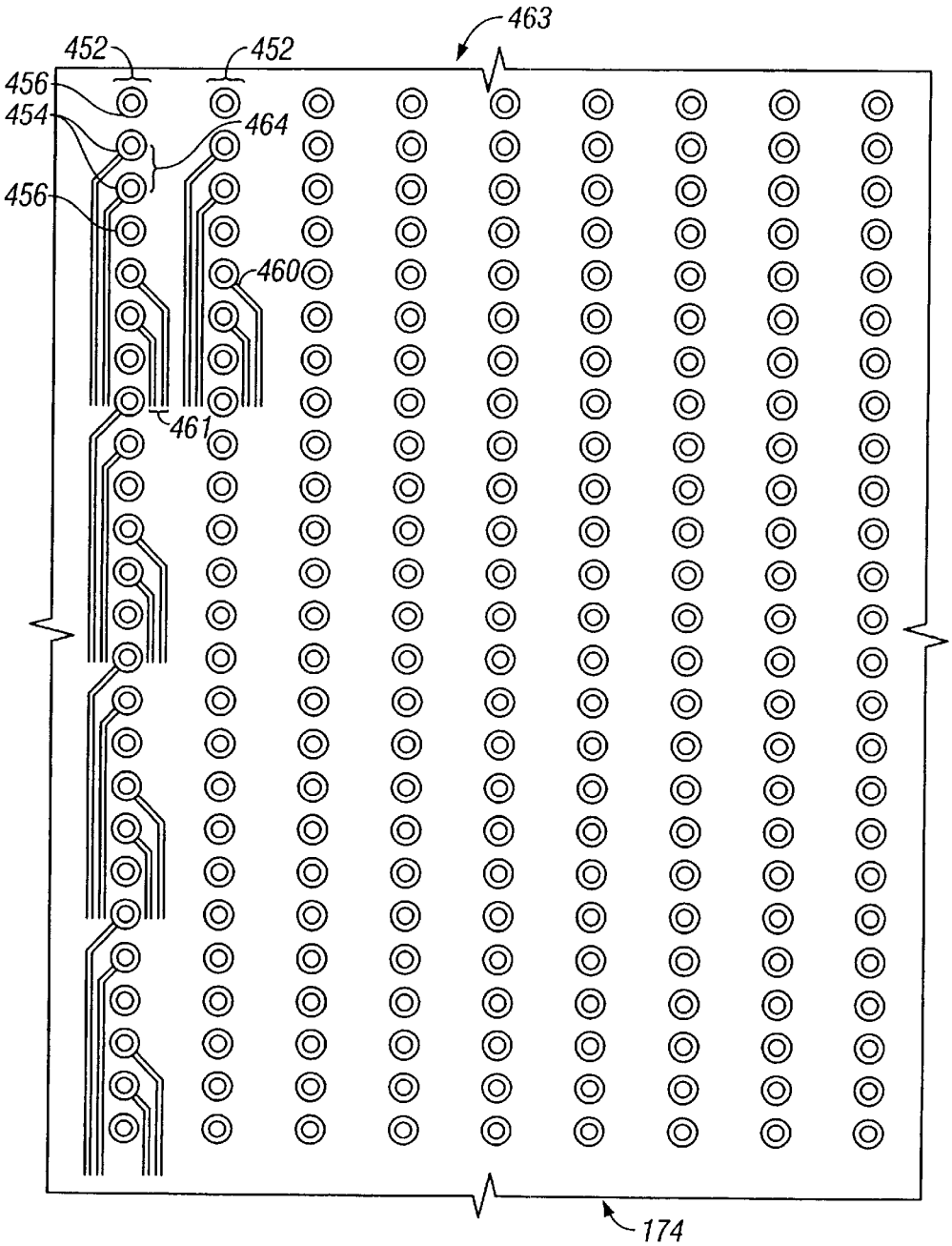
FIG. 13 illustrates a top view of the printed circuit board beneath the organizer base of the receptacle connector.

FIG. 13 illustrates a top view of the printed circuit board 274 beneath the organizer base 210 of the plug connector 200. The printed circuit board 274 includes columns 452 having signal contact pads 454 and ground contact pads 456. Each ground contact pad 456 is alongside a corresponding differential pair 464 of signal contact pads 454. Each column 452 corresponds to a plug wafer 222 (FIG. 4) perpendicular to the printed circuit board 274 and connected to the printed circuit board 274 through the organizer base 210 (FIG. 4) by the compliant contacts. The compliant contacts connect the ground and signal contact pads 170 and 166 on the base mating edge 158 of a plug wafer 222 to corresponding ground and signal contact pads 456 and 454, respectively, in the column 452. Therefore, each ground contact pad 456 and signal contact pad 454 in a column 452 corresponds to a ground contact pad 270 and signal contact pad 266, respectively, in a different receptacle wafer 122 orthogonally connected to the plug wafer 222 that corresponds to the column 452.

The printed circuit board 274 also includes signal traces 460. A differential pair 461 of signal traces 460 extends from each differential pair 464 of signal contact pads 454 within a column 452. As shown, the differential pairs 461 of signal traces 460 alternately extend from different sides of a column 452. Further, in each differential pair 461 of signal traces 460, the signal trace 460 closer to a top edge 463 extends a greater distance than the other signal trace 460 of the differential pair 461.

The top view of the printed circuit board 174 (FIG. 1) of the receptacle connector 100 (not shown) is generally similar to the printed circuit board 274 of the plug connector 200. However, each longer signal trace on the printed circuit board 174 of the receptacle connector 100 corresponds to a shorter signal trace 460 on the printed circuit board 274 of the plug connector 200. Therefore, each signal in each differential pair of signals that is conveyed from the printed circuit board 174 of the receptacle connector 100 to the printed circuit board 274 of the plug connector 200 (or vice versa) travels the same distance. By traveling the same distance, the signals experience no skew, or time difference.

Figure 14:
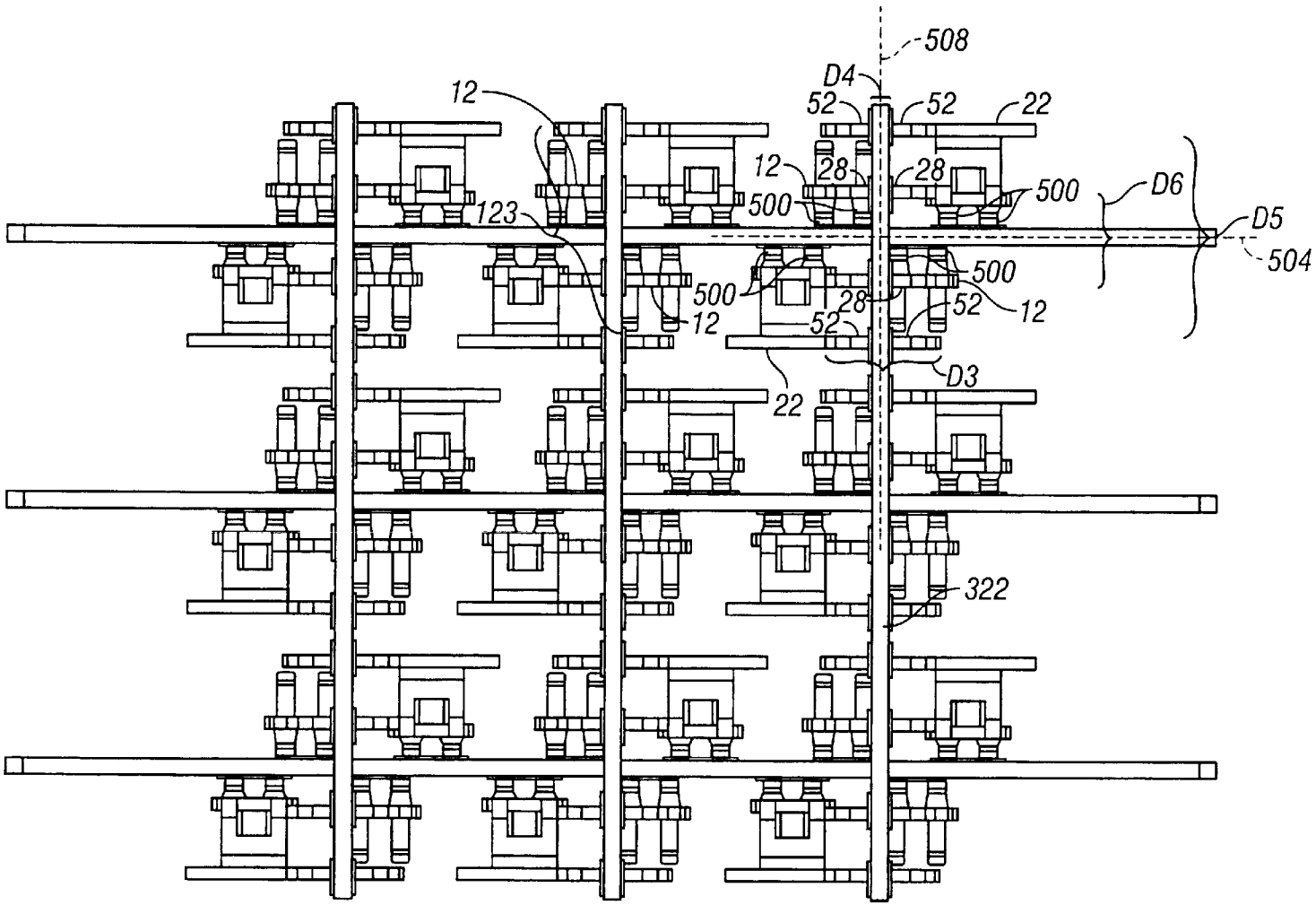
FIG. 14 illustrates a rear view of the signal and ground contacts and positioned on parallel plug wafers formed in accordance with an embodiment of the present invention.

FIG. 14 illustrates a rear view of the signal and ground contacts 12 and 22 positioned on parallel plug wafers 322 formed in accordance with an embodiment of the present invention. In this alternative embodiment, the ground contacts 22 do not have first and second plug interconnects, rather a pair of ground contacts 22 are separately positioned on the parallel plug wafers 322 to correspond to the contact differential pair 123 of the signal contacts 12. Additionally, both the signal and ground contacts 12 and 22 have tips 500. The tips 500 of the ground contacts 12 are offset from each other along a horizontal axis 504 by a distance D3, and the tips 500 of the signal contacts 22 are offset from each other along the horizontal axis 504 by a distance D4. The signal and ground contact pads 260 and 270 on the receptacle wafer 122 of FIGS. 11 and 12 that correspond to the signal contacts 12 and the ground contacts 22, respectively, are similarly offset on each side of the receptacle wafer 122.

The prongs 52 of the ground contacts 12 are offset from each other along a vertical axis 508 by a distance D5, and the prongs 28 of the signal contacts 22 are offset from each other along the vertical axis 508 by a distance D6. The signal and ground contact pads 166 and 170 on the plug wafer 322 that correspond to the signal and ground contacts 12 and 22, respectively, are similarly offset from each other on each side of the plug wafer 322. Distance D3 is greater than distance D4 and distance D5 is greater than distance D6 such that the signal contacts 12 of a contact differential pair 123 are stacked between the ground contacts 22 along the vertical and horizontal axes 508 and 504. Thus, the ground contacts 22 serve as buffers between adjacent contact differential pairs 123 on the receptacle wafers 122 to prevent electromagnetic coupling interference between the signal contacts 12 of the adjacent contact differential pairs 123.

Figure 15:
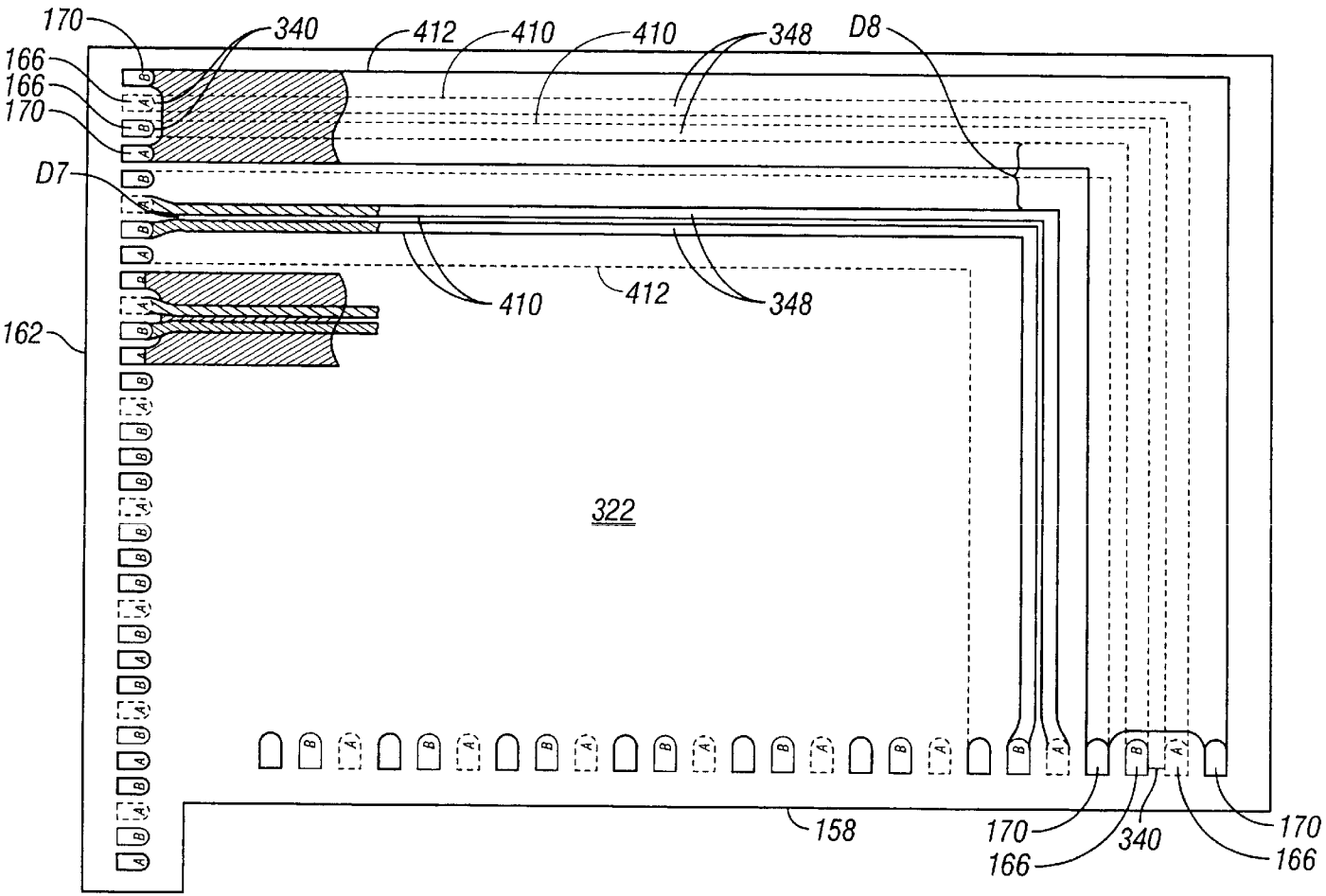
FIG. 15 illustrates a side view of a plug wafer formed in accordance with an embodiment of the present invention.

FIG. 15 illustrates a side view of the plug wafer 322 formed in accordance with an embodiment of the present invention. The plug wafer 322 is compatible with the receptacle wafer of FIGS. 11 and 12 by use of the signal and ground contacts 12 and 22 of FIG. 14. On the receptacle mating edge 162 and the base mating edge 158, corresponding differential pairs 340 of signal contact pads 166 are situated between a pair of ground contact pads 170. The ground and signal contact pads 170 and 166 on one side of the plug wafer 322 are opposite, and interconnected by vias to, identical ground and signal contact pads 170 and 166 on the other side of plug wafer 322. Thus the ground and signal contact pads 170 and 166 engage the prongs 52 of the ground and signal contacts 22 and 12 of FIG. 14, respectively, along the receptacle mating edge 162. The ground and signal contact pads 170 and 166 along the base mating edge 158 are connected to corresponding ground and signal contact pads 456 and 454, respectively, of the printed circuit board 274 of FIG. 13 by the compliant contacts.

The plug wafer 322 also includes signal and ground traces 410 and 412 on opposite sides of the plug wafer 322. The signal traces 410 extend in a differential pair 348 from a differential pair 340 of signal contact pads 166 on the receptacle mating edge 162 to a corresponding differential pair 340 of signal contact pads 166 on the base mating edge 158. Likewise, each ground trace 412 extends from a pair of ground contact pads 170 on the receptacle mating edge 162 to a corresponding pair of ground contact pads 170 on the base mating edge 158. The signal and ground traces 410 and 412 form L-shaped paths across the plug wafers 322 that do not cross each other.

Like the embodiment of the plug wafer 222 shown in FIG. 10, each ground trace 412 and corresponding differential pair 348 of signal traces 410 extend along different sides of the plug wafer 322, alternating sides with every other ground trace 412 and corresponding differential pair 348 of signal traces 410. The dashed lines indicate that the ground trace 412 or signal trace 410 extend along the un-shown other side of the plug wafer 322.

The two signal traces 410 within a differential pair 348 are separated from each other by a trace-to-trace distance D7, and each differential pair 348 of signal traces 410 is separated from an adjacent differential pair 348 of signal traces 410 by a pair-to-pair distance D8. The pair-to-pair distance D8 is greater than the trace-to-trace distance D7 in order that the signal traces 410 within a single differential pair 348 of signal traces 410 are more closely EM coupled to one another than to any signal trace 410 in an adjacent differential pair 348 of signal traces 410.

The plug and receptacle connectors confer the benefit of making an electrical connection between orthogonal electronic wafers by way of differential pairs of signals. In the orthogonally mated plug and receptacle connectors, two signal contacts and a ground contact are aligned in such a way that the ground contact touches both sides of a plug wafer and a receptacle wafer orthogonally aligned with each other while each signal contact touches both sides of the plug wafer and touches one side of the receptacle wafer opposite the other signal contact. The signal and ground contacts thus allow for a differential pair of signals, to be conveyed from the plug wafer to an orthogonally aligned receptacle wafer with limited interference.

Also, the receptacle wafers have differential pairs of signal traces extending between signal contact pads with the signal traces of each differential pair situated closer to each other than to signal traces of an adjacent differential pair so that the signal traces of each differential pair are closely EM coupled with each other. The two wafers each include differential pairs of signal traces that correspond to each other so that the paths of each signal in the corresponding differential pairs of traces are the same, so the signals experience limited differentiation. Finally, the plug interconnects of each ground contact are further offset from each other along a receptacle wafer than the plug interconnects of the signal contacts aligned with the ground contact so that the signal contacts of each contact differential pair do not interfere with signal contacts of another adjacent contact differential pair.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

wafers having arranged in at least one differential pair on each of at least first and second wafers;

a first connector housing retaining a first group of wafers;

a second connector housing retaining a second group of wafers; and signal contacts joining said differential pairs of said signal traces on said first wafer with a corresponding differential pairs of said signal traces on said second wafer said first and second connector housing joining said first group of wafers in a non-parallel relationship to said second group of wafers.

2. The electrical connector assembly of claim 1, wherein said first and second wafers are aligned orthogonal to one another.

3. The electrical connector assembly of claim 1, wherein said signal contacts each includes a body portion with a forked arm on one end and a flexible beam on an opposite end, said forked arm receiving therein an edge of a wafer from said first group of wafers, said flexible beam contacting one side of a wafer from said second group of wafers.

4. The electrical connector assembly of claim 1, said signal contacts further comprising first and second signal contacts arranged in a differential pair, each of said first and second signal contacts having a forked arm receiving therein an edge of a wafer from said first group of wafers and having a flexible beam, contacting only one side of a wafer from said second group of wafers.

5. The electrical connector assembly of claim 1, wherein said signal contacts are arranged in differential pairs, each differential pair of said signal contacts joining a differential pair of said signal traces on a wafer from said first group of wafers with a corresponding differential pair of said signal traces on a wafer from said second group of wafers.

6. The electrical connector assembly of claim 1, further comprising ground contacts joining said ground traces on said first and second groups of wafers and comprising signal contacts arranged in differential pairs wherein said signal contacts in each differential pair are separated from one another by a ground contact.

7. The electrical connector assembly of claim 1, further comprising ground contacts joining said ground traces on said first and second groups of wafers and comprising signal contacts arranged in differential pairs, each differential pair of said signal contacts being located along a first axis with a corresponding ground contact located therebetween.

8. The electrical connector assembly of claim 1, further comprising ground contacts joining said ground traces on said first and second groups of wafers and wherein said signal contacts are arranged in differential pairs, each differential pair of said signal contacts being stacked with a corresponding ground contact along a first axis, each differential pair of said signal contacts having beams offset from one another in a direction transverse to said first axis.

9. An electrical connector assembly comprising:

first and second wafers each having signal traces arranged in differential pairs;

a first connector housing adapted to retain said first wafer;

a second connector housing adapted to retain said second wafer; and signal contacts joining at least one differential pairs of said signal traces on said first wafer with a corresponding differential pair of said signal traces on said second wafer, said first and second connector housings joining said first wafer in a non-parallel relationship to said second wafer.

10. The electrical connector assembly of claim 9, said signal contacts further comprising first and second signal contacts interconnecting said differential pair of said signal traces on said first wafer with said differential pair of said signal traces on said second wafer, said first and second wafers being aligned orthogonal to one another.

11. The electrical connector assembly of claim 9, wherein said signal contacts each includes a body portion with a forked arm on one end and a flexible beam on an opposite end, said forked arm receiving therein an edge of said first wafer, said flexible beam contacting one side of said second wafer.

12. The electrical connector assembly of claim 9, said signal contacts further comprising first and second signal contacts arranged in a differential pair, each of said first and second signal contacts having a forked arm receiving therein an edge of said first wafer and having a flexible beam; contacting only one side of said second wafer.

13. The electrical connector assembly of claim 9, wherein said signal contacts are arranged in differential pairs, each differential pair of said signal contacts joining a differential pair of said signal traces on said first wafer with a corresponding differential pair of said signal traces on said second wafer.

14. The electrical connector assembly of claim 9, further comprising ground contacts joining said ground traces on said first and second wafers, wherein said signal contacts are arranged in differential pairs, and wherein said signal contacts in each differential pair are separated from one another by a ground contact.

15. The electrical connector assembly of claim 9, further comprising ground contacts joining ground traces on said first and second wafers and wherein said signal contacts are arranged in differential pairs, each differential pair of said signal contacts being located along a first axis with a corresponding ground contact located therebetween.

16. The electrical connector assembly of claim 9, further comprising ground contacts joining ground traces on said first and second wafers and wherein said signal contacts are arranged in differential pairs, each differential pair of said signal contacts being stacked with a corresponding ground contact along a first axis, each differential pair of said signal contacts having beams offset from one another in a direction transverse to said first axis.

17. An electrical connector assembly comprising:

a plurality of wafers having ground and signal traces, said signal traces being arranged in differential pairs;

a first connector housing including channels adapted to retain a first group of wafers;

a second connector housing including channels adapted to retain a second group of wafers;

a wafer interface secured to one of said first and second connector housings, said wafer interface including cavities;

ground and signal contacts loaded into said cavities for connection to corresponding ground and signal traces, said signal contacts being arranged in differential pairs with corresponding ground contacts located therebetween along a first axis, each ground contact and signal contact including ground beams and signal beams, respectively, each ground beam being located immediately adjacent and facing a corresponding signal beam; and said wafer interface holding said signal beams in a biased state to deflect said signal beams away from corresponding ground beams to define gaps therebetween.

18. The electrical connector assembly of claim 17, each ground contact having a pair of said ground beams offset from one another in a direction transverse to said first axis.

19. The electrical connector assembly of claim 17, said signal beams of each differential pair of said signal contacts being offset from one another in a direction transverse to said first axis.

20. The electrical connector assembly of claim 17, wherein said signal contacts in each differential pair are separated from one another by a single ground contact.

21. The electrical connector assembly of claim 17, wherein each differential pair of said signal contacts joins a differential pair of said signal traces on one side of a wafer from said first group of wafers with a corresponding differential pair of said signal traces on opposite sides of a wafer from said second group of wafers.

22. The electrical connector assembly of claim 17, wherein said signal traces in said differential pairs are separated by a first distance that is shorter than a second distance that separates adjacent signal traces of adjacent differential pairs of signal traces.

23. An electrical wafer configuration for carrying differential pairs of signals, comprising:

a first wafer having a differential pair of signal traces thereon;

a second wafer having a differential pair of signal traces thereon, said first and second wafers being joined in a non-parallel relationship with one another; and signal contacts joining said differential pair of signal traces on said first wafer with said differential pair of signal traces on said second wafer.

24. The electrical wafer configuration of claim 23, further comprising at least one housing retaining said first and second wafers in said non-parallel relationship.

25. The electrical wafer configuration of claim 23, wherein at least one of said first and second wafers include at least one ground trace.

* * * * *